US005282885A

United States Patent [19]

Cameron

[11] Patent Number: 5,282,885

[45] Date of Patent: Feb. 1, 1994

[54] ELECTROSTATIC GAS CLEANING PROCESS AND APPARATUS

[75] Inventor: Gordon M. Cameron, Willowdale, Canada

[73] Assignee: Cecebe Technologies Inc., Willowdale, Canada

[21] Appl. No.: 824,127

[22] Filed: Jan. 22, 1992

[51] Int. Cl.[5] ..... B03C 3/16

[52] U.S. Cl. ..... 95/66; 55/222; 55/269; 95/67; 95/71; 96/27; 96/53; 96/55; 96/74

[58] Field of Search ..... 55/7-11, 55/122, 134, 135, 268, 269, 222; 95/63-67, 71; 96/27, 52, 53, 55-57, 74

[56] References Cited

U.S. PATENT DOCUMENTS

| | | | |
|---|---|---|---|
| 2,002,704 | 5/1935 | Miller | 55/9 |
| 2,209,798 | 7/1940 | Subkow | 55/9 X |
| 2,431,236 | 11/1947 | Fleming et al. | 55/9 X |
| 2,675,891 | 4/1954 | Frey | 55/9 X |
| 2,855,292 | 10/1958 | Vogt | 55/9 X |
| 3,633,337 | 1/1972 | Walker et al. | 55/134 X |
| 3,830,039 | 8/1974 | Ebert et al. | 55/9 X |
| 3,874,858 | 4/1975 | Klugman et al. | 55/122 X |
| 3,958,958 | 5/1976 | Klugman et al. | 55/10 X |
| 4,750,916 | 6/1988 | Svensson | 55/9 X |
| 4,778,493 | 10/1988 | Fitch et al. | 55/135 X |

*Primary Examiner*—Richard L. Chiesa
*Attorney, Agent, or Firm*—Bereskin & Parr

[57] ABSTRACT

In the purification of gases generated in metallurgical and similar furnace operations, the impurities include solid particles and compounds or elements which are gaseous at the furnace temperatures and only form solid or liquid at temperatures approaching ambient conditions. Proper cleaning therefore requires cooling of the gases to at least the water dew point to cause these impurities to form as particles or droplets. This invention describes a process and apparatus for collecting such particles or droplets in which a charging device and condensation equipment are combined to provide a simple, yet effective apparatus at a fraction of the cost of conventional apparatus.

14 Claims, 6 Drawing Sheets

ELECTROSTATIC GAS CLEANING PROCESS AND APPARATUS

FIELD OF THE INVENTION

The present invention relates to a process and apparatus for cleaning smelter and other similar furnace gases.

BACKGROUND OF THE INVENTION

Smelter gases normally contain significant quantities of contaminants which must be removed prior to discharge of the gases to the atmosphere or prior to feeding the gases to sulfuric acid or sulfur dioxide manufacturing facilities.

The gas contaminants may include unreacted solids or concentrate, calcined materials, slag, other feed materials, metals which are more volatile than the metal being recovered, and a variety of other elements such as mercury, arsenic, antimony, bismuth, selenium, tellurium, and sulfur. At furnace temperatures these impurities may be solid, liquid, or gaseous in form. As the gas cools the molten materials solidify, and some of the gaseous impurities start to form solid or liquid particles or droplets which often are found as fine fumes having particle sizes well below one micron. These fine particulates are almost impossible to remove by inertial separation or scrubbing means and require the use of expensive wet electrostatic precipitators.

Smelter gases are generated at a variety of temperatures depending on the metal being recovered. Typical temperatures for zinc are in the range 900 to 1,000 degrees centigrade while copper temperatures are closer to 1,200 degrees centigrade. In classical smelter gas cleaning practice, the hot gases from the smelting furnace are cooled initially to temperatures in the range 300 to 350 degrees centigrade using boilers in which high pressure steam is generated. The boilers are usually of the water-in-tube type and are designed to handle high dust loads. From the boilers the gas then flows to hot electrostatic precipitators where dust is removed. Typical dust removal efficiencies may run as high as 99%, but in many cases lower efficiencies have had to be accepted. Various considerations are taken into account in selecting an operating temperature range for the precipitator including the temperature which can be tolerated by carbon steel, which is typically used in hot precipitator construction, the dew point temperature of the gas which dictates the lowest acceptable metal temperature in the precipitator, and the temperature which gives the best electrical conductivity of the particles being collected. Accordingly, the resultant operating temperature is a compromise.

In some cases, the smelter furnace off-gas is quenched, as opposed to being cooled in a boiler, the quenching serving to reduce the temperature to an extent suitable for hot precipitators. In relatively few cases, where oxygen flash smelting is used, the gas is cooled down by quenching to the wet-bulb temperature and hot electrostatic precipitators and boilers are totally avoided. In such cases, the wet gas cleaning systems have to handle the complete flow of solids and other contaminants from the furnace. These variations are the exception rather than the rule, and for the purpose of the present discussion classic practice has been assumed.

From the electrostatic precipitators the gas next flows to the wet scrubbing system. The first stage in this system saturates the gas with water by contacting the gas with either water or a weak sulfuric acid solution.

Depending on the inlet gas composition and temperature and the concentration of the acid used to saturate the gas, the temperature of the saturated gas will normally lie in the range of 55 to 85 degrees centigrade. The water vapour content in this gas can range as high as 40%. This first quenching operation does some cleaning but is primarily designed to cool the gas through the temperature range in which the gas is most corrosive, to saturation temperature. In the first quenching step the bulk of the gaseous impurities condense out in a variety of forms which offer different difficulties of removal. Ordinary solid particles and droplets are relatively easy to remove by inertial separation means. Fine chemical fumes, which can be formed by such substances such as $H_2SO_4$, $As_2O_3$, Pb, and $SeO_2$, are normally much smaller (in the range 0.1 to 1 micron) and can only be removed by high energy scrubbing or by electrostatic precipitators. Mercury and the water vapour which is present in excess of that required to form $H_2SO_4$ cannot be removed at this stage. The gas must be cooled to lower temperatures in the range 30 to 40 degrees centigrade for mercury removal.

The saturated gas now passes to wet scrubbers and gas coolers where the bulk of the impurities are removed and the water vapour content is reduced to a level consistent with the quality of acid being produced. This equipment can include packed towers, plate type scrubbers, gas coolers, indirect gas coolers where the gas is contacted with cooled weak acid, venturi scrubbers and a wide variety of other devices. Typically the gas cleaning system will consist of a train of such devices.

From these devices, the gas which now has been cleaned of almost all the solid particles and contains primarily acid mist, passes to a series of wet electrostatic precipitators where the remaining contaminants are removed.

Wet electrostatic precipitators are predominantly of two types, one type comprising wire electrodes located in tubes and other comprising wire electrodes located between collecting plates. In both cases, a corona discharge is maintained on the wire and the particles are charged by electrical charges generated in the corona. The charged particles then move, under the influence of the electrical field between the wire and the grounded surface, to the collection surface. A typical electrostatic precipitator will have a gas residence time in the range of 4 seconds and an efficiency of 98%. Where tube type units are used, the tubes are typically 250 mm in diameter and tube lengths run to as much as 6 meters. Frequently, where larger residence times and efficiencies are required, such units are arranged in series and a large plant can require as many as 10 or 12 of such units.

Materials used to construct such devices include carbon-steel, lead, lead-lined steel, stainless steels, and a variety of plastics.

A variety of type of precipitators are available, including round tube, hexagonal tube, square tube, concentric ring, and plate type units.

Removal of the process heat from the gas, as discussed above, is normally carried out in stages. The first stage is in the boilers, after the furnace, where the gas is cooled to 300–350 degrees centigrade. In the next step, the gas is adiabatically saturated by contacting the hot inlet gas with a recirculating stream of scrubbing acid. The recirculating stream may have a composition ranging from 1 to 50% acid. It includes impurities previously removed from the gas. While the gas temperature drops drastically in this stage, the drop in temperature is compensated for by a significant increase in the water vapour content. Next, the gas flows to a heat removal stage in which direct and/or indirect contact coolers are employed. These units operate by a variety of means including simple condensation cooling in heat transfer apparatus, direct contact with indirectly cooled weak acid streams in such devices as venturi scrubbers, plate scrubbers, or packed towers and combinations of the above. The complexity and the expense of the heat and excess moisture removal can often pose a more serious problem to the designer of metallurgical plants than the basic gas cleaning problems described above. Depending on the approach used, this cooling may involve anywhere from one to three heat removal steps. A plate scrubber, for example, contacts the gas in two different sections which are in series with respect to the flow of gas. The upper section, containing plates, is cooled, while the lower first section, using sprays, is frequently uncooled. In such scrubbers, the heat is transferred from the gas to the countercurrent streams of weak acid which themselves are cooled by cooling water in separate exchangers. Where condensers are used, anywhere from one to three units may be found in series depending on the type of condenser used, and the cooling water used may flow from one unit to the next or in parallel through all units.

Many reasons exist for better gas cleaning systems. The capital cost of electrostatic precipitator units is high, good gas distribution between and within such units is difficult to ensure, and the units occupy a large amount of space. Also, the performance of such units is usually not good enough for most downstream plants. The development of alternatives has covered the whole range of the cleaning problem from the saturation devices to the precipitators. However, most prior art patents relevant to this field are directed to improvements of single stages of the gas cleaning apparatus and little effort appears to have been spent on integrated approaches which take advantage of all of the equipment required for smelter gas treatment duty. The background art in the field of gas cleaning is extremely large as there are many fields where gases must be cleaned. Notwithstanding this prior art, an integrated approach to cleaning of gases, where one has such mixtures as one finds in the off-gases from metallurgical furnaces, has not been considered and there is no general agreement on how such cleaning should be done. Prior art patents which address the objects of the present invention by making more effective use of the electrostatic principle, are even more limited in number.

One such prior art patent is U.S. Pat. No. 3,874,858. This patent covers a process comprising a gas particle charging step followed by passage of the charged gas through an irrigated packed bed or fiber bed where the particles are attracted to the uncharged packing or fibers. The approach does not use an imposed electrostatic field to cause the particles to flow to the neutral surface but counts on relatively low velocities and significant residence time to permit the charged particles to migrate to the uncharged surface. U.S. Pat. No. 3,958,958 contains the relevant apparatus claims associated with U.S. Pat. No. 3,874,858.

U.S Pat. No. 4,778,493 also discusses electrostatic precipitation and describes techniques by which the charge on the smaller particles can be drastically increased. In this patent, particulate contaminants are pulse charged in different regions of the gas cleaning process, starting with the charging of the fine particles in the absence of a static electrical field. More conventional charging in the presence of an electrostatic field then follows with the field causing the particles to move to the collecting surface. After this collection, electric bombardment is used to charge the few remaining particles. Collection in this case is again by motion in an electrostatic field as in the standard electrostatic precipitator.

SUMMARY OF THE INVENTION

The present invention provides a more effective use of the electrostatic principle of cleaning smelter and other similar furnace gases. In accordance with the process of the present invention, the gas stream leaving the furnace is first quenched with water or dilute sulfuric acid in order to cool the gas, condense fumes out of the gas phase and saturate the gas with water. Particles in the gas stream are then electrostatically charged and the "charged" gas stream is passed through a condenser. In the condenser, the charged particles migrate to the condenser surface, with the assistance of a large net flow of condensing water vapour. The condensing water vapour also irrigates the condenser surface and washes the particles away for collection. To effectively clean the gas stream, the process may employ a plurality of cycles of charging and condensation. The process can be readily adapted to the gas cleaning duty involved in the production of sulfuric acid or sulfur dioxide.

In one aspect the invention provides a process for cleaning smelter and other similar furnace gases comprising the steps of:

(a) cooling and saturating the gas by contact with a stream containing water, (b) electrostatically charging particles in the saturated gas to form a charged gas, (c) passing said charged gas through a condenser, thereby removing water from said gas, (d) the passage of said charged gas through said condenser also removing charged particles from said gas, (e) removing from said condenser a liquid stream comprising water condensed from said gas, and with said stream, also substantially removing the particles removed from said gas.

Important variations on the basic design concept, within the scope of the invention, include the use of multiple charging zones in a single condenser unit to permit the gas to be charged between multiple passes through the condenser and the use of sprays to provide additional surface area for attraction of charged particles and to assist in washing the collecting surface.

Downstream from the last cycle of charging and condensation, a process designed in accordance with the present invention may also include a packed tower for mercury removal and a packed drying tower, both of which may be employed to collect charged particles which are generated in separate charging devices prior to passage through the towers. Sprays may be used in the condenser and mercury removal tower to provide additional surface area for attracting charged particles and to assist in washing the collecting surface.

Various types of charging procedures and associated apparatus may be employed, depending on the particular stage of the cleaning process, including pulse charging, field charging and electric bombardment. Charging apparatus for the purposes of this invention has been shown in many prior art patents including U.S. Pat. Nos. 3,633,337, 3,874,858 and 4,778,493 and is not the subject of this invention.

In another aspect the invention provides apparatus for cleaning smelter and other furnace gases containing sulfur oxide, comprising:

(a) means for cooling and saturating the gas by contact with a stream containing water, (b) means connected to said means (a) for electrostatically charging the gas therefrom to produce a stream of charged saturated gas, (c) and at least one condenser connected to said means (b) for both condensing water vapour from said charged saturated gas and removing charged particles therefrom, (d) said condenser including means for draining condensed water and collected particles therefrom.

Further objects and advantages of the invention will appear from the following description, taken together with the accompanying drawings.

DETAILED DESCRIPTION OF THE PREFERRED EMBODIMENTS

Figure 1:
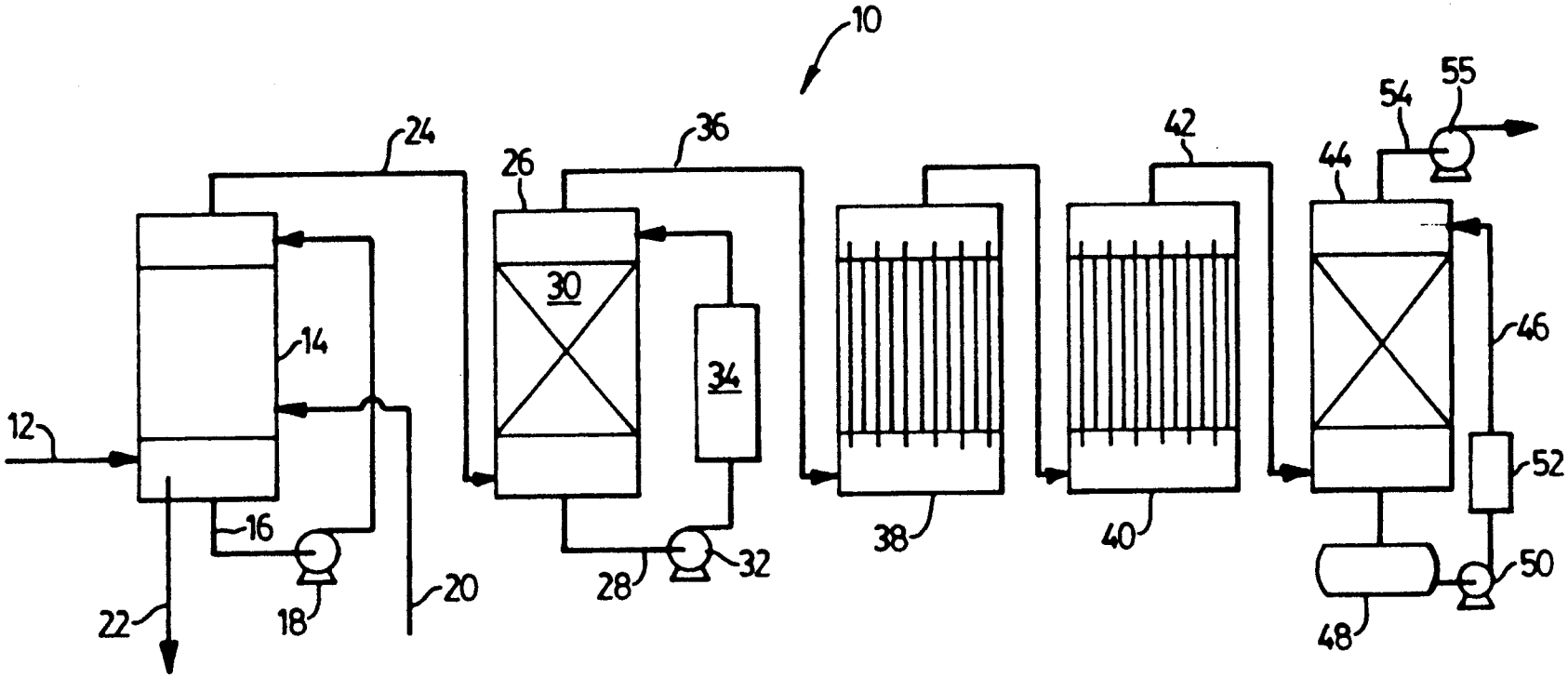
FIG. 1 (PRIOR ART)
FIG. 1 is a schematic diagram of a typical furprior art smelter gas cleaning process.

FIG. 1 shows a typical prior art smelter gas cleaning system 10 for a sulfuric acid plant. In system 10 a hot gas stream 12 from the sulfuric acid plant (not shown) flows to a quenching tower 14, where the gas is cooled and saturated with water. The gas quenching tower 14 may be an open spray tower, or a venturi scrubber, or may be of other conventional design. A weak acid circulation stream 16 is drawn from the bottom of tower 14, directed through a recirculating pump 18, and injected into the top of the tower. A make up water stream 20 is provided. An overflow stream 22 leaves the bottom of the tower 14.

The saturation process in tower 14 results in a net evaporation of water in the tower. A saturated gas stream 24 leaves the spray tower 14 and flows to a gas cooling tower 26, where it is cooled by a countercurrent recirculating stream of cooled weak acid 28 in a section of tower packing 30. Suitable tower packing materials include ceramic materials of various shapes. The weak acid stream is recirculated by pump 32, through a cooler 34, or set of coolers, where it is cooled with water.

The cooled gas stream 36 from tower 26 passes to two electrostatic precipitators 38, 40 arranged in series, where the dust and mist and fume are removed. These costly precipitators will typically have a gas residence time of at least four seconds and more typically six seconds. There may be many units in parallel in a large application. The cleaned gas 42 from precipitator 40 then passes to a conventional drying tower 44 where the gas is dried to a dew point of −40 degrees centigrade by contact with a recirculating stream 46 of strong (93 to 96%) sulfuric acid. Stream 46 is recirculated from the bottom of tower 44 to a reservoir 48 and then through a circulating pump 50 and an acid cooler 52. The stream of dried and cleaned gas 54 from the top of tower 44 now passes through a blower 55 to the contact section of the acid plant.

Figure 2:
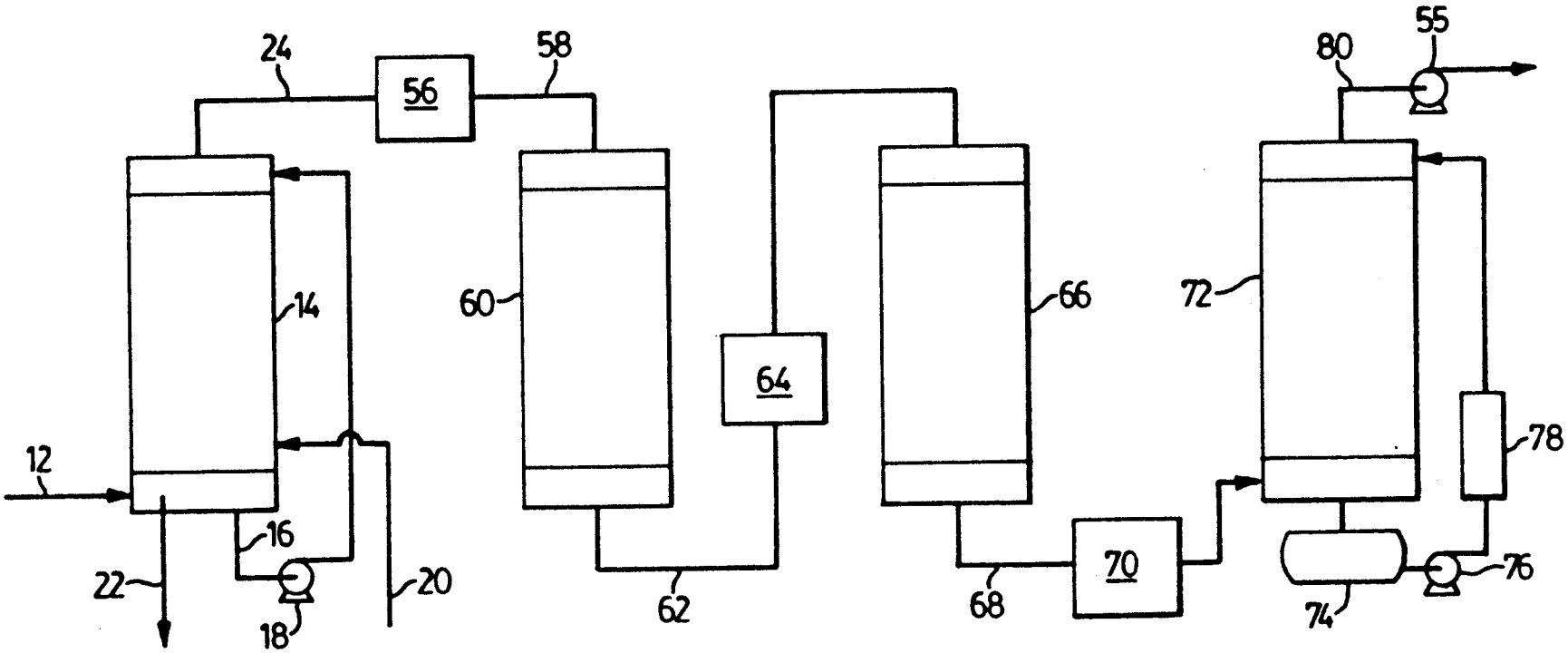
FIG. 2 is a schematic diagram of a preferred embodiment of the process of the present invention.

A preferred embodiment of the process of the present invention is next described with reference to FIG. 2, where corresponding reference numerals indicate parts corresponding to those of FIG. 1. As in FIG. 1, the hot gas stream 12 flows to a quenching tower 14, where the gas is saturated with water and cooled. As before, a saturated gas stream 24 leaves the quenching tower 14.

At this point, the process diverges from the conventional process. The saturated gas stream 24 passes through a conventional electrostatic charging apparatus 56 where charge is placed on the particles, fume, and droplets. The gas stream 58 containing the charged particles then passes to a primary condenser 60 where the gas is cooled, the bulk of the excess water vapour is removed from the gas and most of the charged particles are collected on the condenser surface. The partly cooled and cleaned gas stream 62 then passes to a further electrostatic charging stage 64 and to a second condenser 66 for further water vapour condensation and particle removal. Optionally, one or more charging devices may be integrated with a heat exchanger in a single apparatus as will be discussed with reference to FIGS. 3 and 4.

After the last condensation stage 66, the gas stream 68 is typically at a temperature in the range of 30 to 40 degrees centigrade. The impurities remaining in the gas at this point are reduced to fine fume, since solids and larger particles are easier to remove. The fume consists essentially of sulfuric acid mist. The cooled but still humid gas 68 then passes to a further electrostatic charging device 70 and then to a drying operation similar to the one previously described, comprising a drying tower 72, an acid reservoir 74, a circulating pump 76 and a drying acid cooler 78. However, in the present system the drying tower 72 now removes not only the water vapour remaining but also the remaining charged particles. (The drying tower 72 will be described in more detail below, with reference to FIG. 6.) A stream of dry and clean gas 80 then flows to the blower 55 and to the contact section of the acid plant for recovery of the sulfur oxide values.

It will be seen that in contrast to the prior art gas cleaning systems, the process or apparatus of the present invention does not rely on an established electric field or an extended residence time in proximity to an electrically neutral collecting surface, to attract charged particles for collection. In a relatively short space of time, through forces of attraction and repulsion between particles, the charged particles migrate to the electrically neutral condenser surface with the assistance of a large net flow of condensing water vapour towards the condenser surface. The surface area of the collecting surface required for the condensers is of the same order of magnitude as the surface area that is required to collect charged particles in electrostatic precipitators. However, in the charging devices a residence time of 0.1 to 1.0 seconds is typically sufficient to charge the particles and residence times in the condensers are typically in the order of one second. In contrast, residence time in the electrostatic precipitator or cooling tower is in the 4 to 6 second range.

Thus, the present invention uses the electrostatic principle to effectively remove sub-micron size particles from hot furnace gases, without employing the costly prior art electrostatic precipitators. As compared to the use of electrostatic precipitators, there are also many other advantages in combining an electrostatic charging device and a condenser for the electrostatic particle removal duty. Firstly, the natural flow of charged particles to the condenser surface is assisted by a large net flow of condensing water vapour towards this surface. Secondly, the condensation process results in vigorous irrigation of the metal surface of the condenser, which further improves the contact between the gas and the condensed vapour. Thirdly, the construction of the condenser as compared with the electrostatic precipitator is simpler and much more compact. In particular, the scale of the tube diameters in the condenser is typically at least ten-fold smaller. Gaps between tubes are also much smaller. Optimal tube layout geometries can be employed in the condenser, whereas in the electrostatic precipitator, the geometry is constrained to allow an electric field to be generated. Furthermore, the greater compactness of the tube layout in the condenser allows this equipment to be fabricated in controlled environments where better quality can be assured.

By employing the process of the present invention, efficiency of removal of particulate contaminants can be very high after three charging and removal stages, which is adequate for most metallurgical acid plant applications. Because the apparatus required to use in the present invention is relatively inexpensive compared to the cost of electrostatic precipitators, additional stages of charging and condensation can also be implemented at much reduced costs.

The condensers 60, 66 may be conventional shell and tube heat exchangers having either shell side or tube side gas flow. The surface area exposed to the gas in such heat exchangers is normally equal to the surface area in the electrostatic precipitators, and yet such heat exchangers are more compact. In a typical heat exchanger the tubes are commonly one inch or less in diameter (as compared with 10 inches in the classic precipitator) and the gap between tubes is small (typically 0.25 inches).

Figure 3:
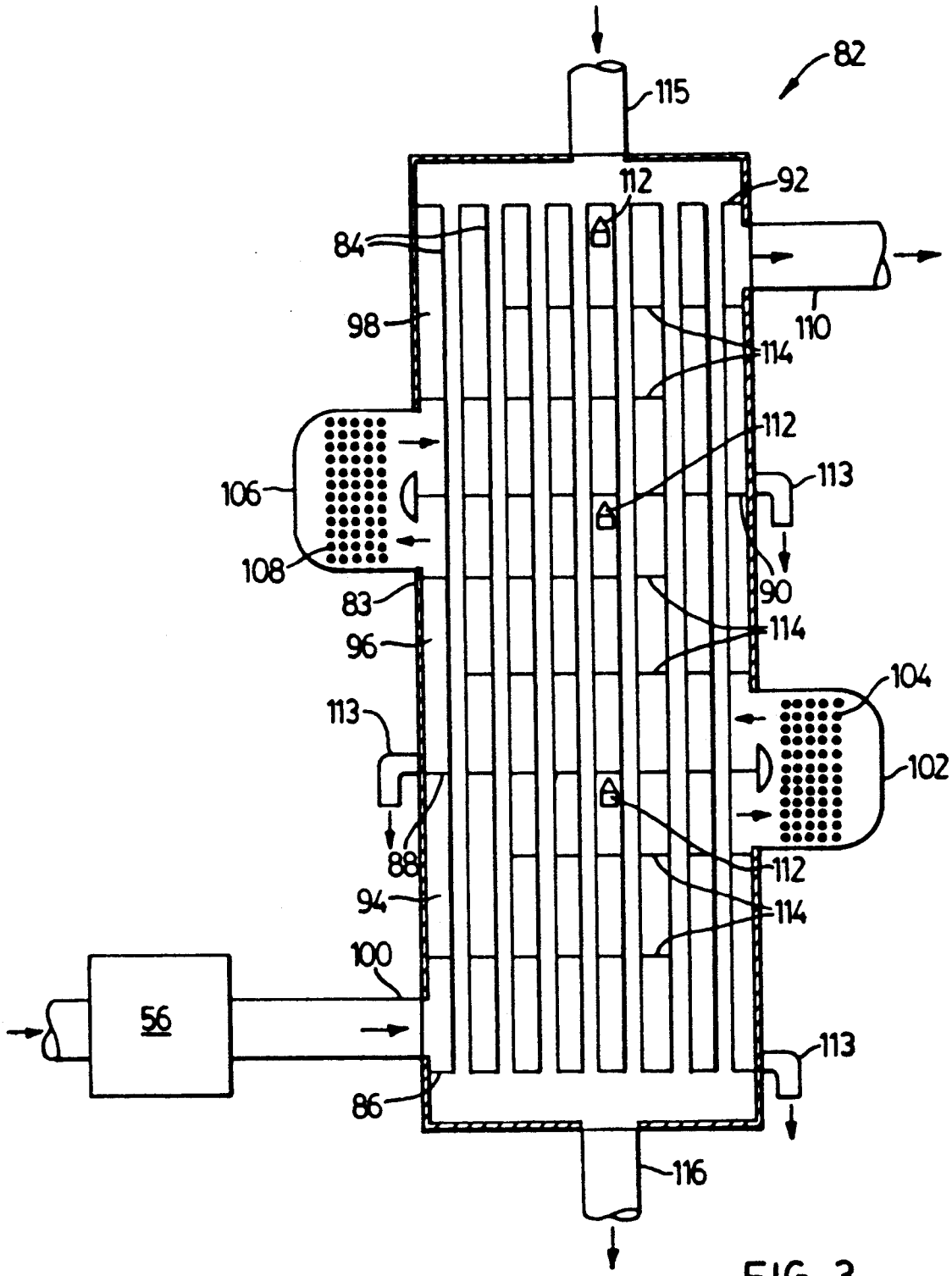
FIG. 3 is a schematic representation of a shell and tube heat exchanger which integrates multiple charging devices and multiple condensing zones within one unit.

If desired, the charging and condensing apparatus may be combined, as shown in FIG. 3. FIG. 3 shows a shell and tube heat exchanger 82 having a cylindrical shell 83, tubes 84, and tube sheets 86, 92 and baffles 88, 90, which divide exchanger 82 into three separate condensing zones 94, 96, 98. Gas from electrostatic charger 56 enters exchanger 82 at inlet 100 and passes through condensing zone 94. The gas then passes through a C-shaped duct 102 into condensing zone 96. Duct 102 contains charging electrodes 104 to re-charge particles in the gas. The gas leaving zone 96 then passes through another C-shaped duct 106 containing further charging electrodes 108, and into zone 98. The cooled and cleaned gas leaves zone 98 at outlet 110. Spray nozzles 112 may be provided in each zone to provide additional surface area (constituted by the sprayed liquid droplets) for charged particle collection. The sprayed liquid may be water or weak sulfuric acid.

Drainage means, diagrammatically indicated at 113, are provided to remove the condensed liquid streams, and with them the collected particles, from the tube sheets and baffles 86, 88, 90. The spray from nozzles 112 assists in flushing these materials from the exchanger. If desired, additional baffles 114 may be provided as are conventional in shell and tube heat exchangers, so that the gas will flow in a tortuous path through each zone. Cooling water enters the tubes at inlet 115 and leaves at outlet 116.

Figure 4:
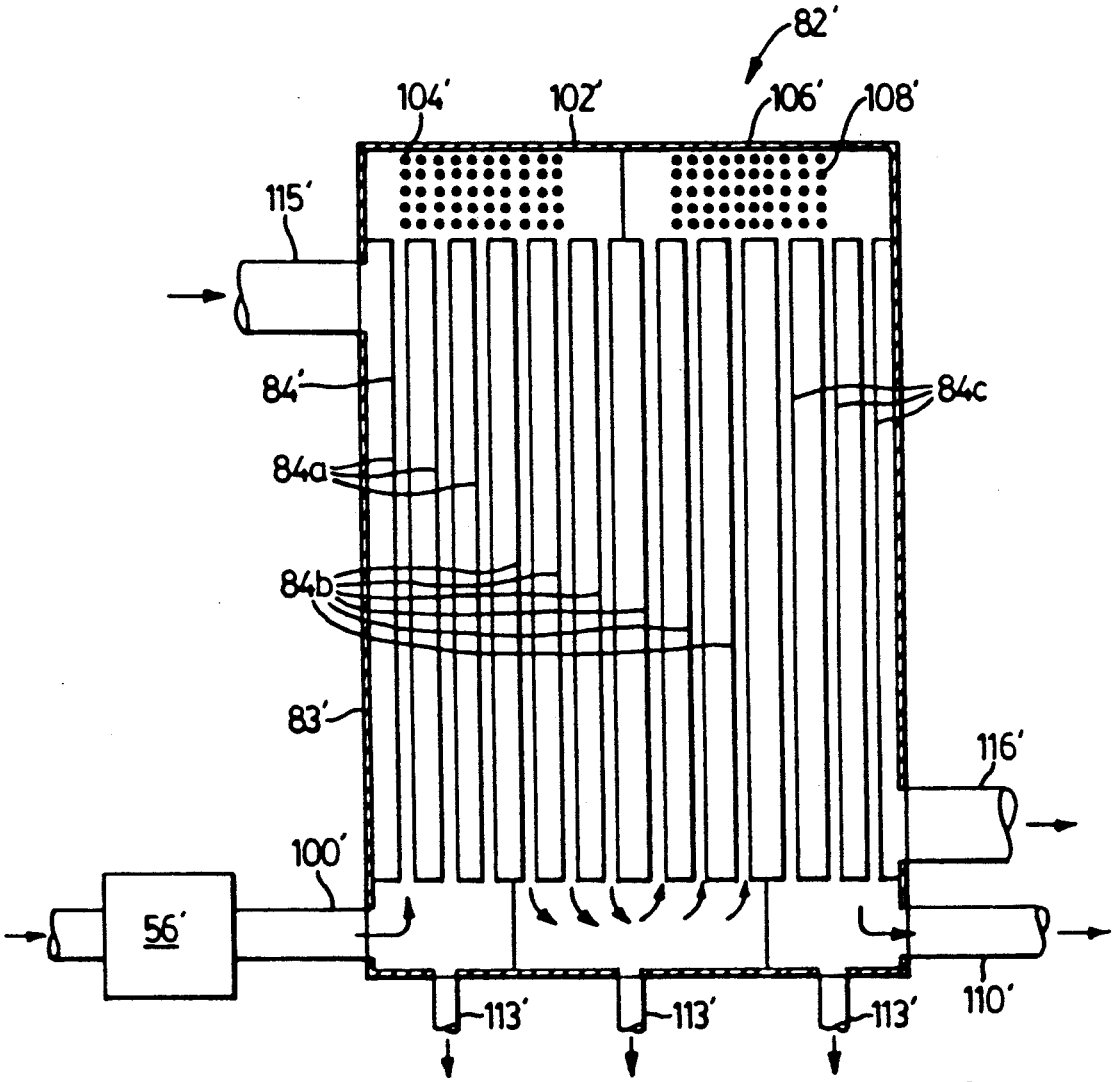
FIG. 4 is a schematic representation of a modified shell and tube heat exchanger which also integrates multiple charging zones and multiple condensing zones within one unit.

While FIG. 3 shows shell side gas flow and tube side water flow, this can be reversed if desired, i.e. the gas can flow through the tubes 84', as shown in FIG. 4 where primed reference numerals indicate parts corresponding to those of FIG. 3. In this case the charged gas from charger 56' will flow through a first set **84*a* of the tubes 84', then through a charging zone 102', then through a set 84*b* of the tubes 84' (connected to set 84*a* by charging zone 102'), then through another charging zone 106', and then through a third set 84*c* of the tubes 84'**. In this way two, three or more condensation zones can be established.

Additional water or weak acid spray nozzles, not shown, can be provided to spray through the tubes 84'. Drainage outlets 113' are provided for the tube sets **84*a*, 84*b*, 84*c***.

In the FIG. 4 arrangement, the charging zones 102', 106' are located at the top of the heat exchanger 82', where they will not receive cascades of flowing water The cooling water inlet and outlet 115', 116' are now connected to the shell-side space instead of to the tubes.

Figure 5:
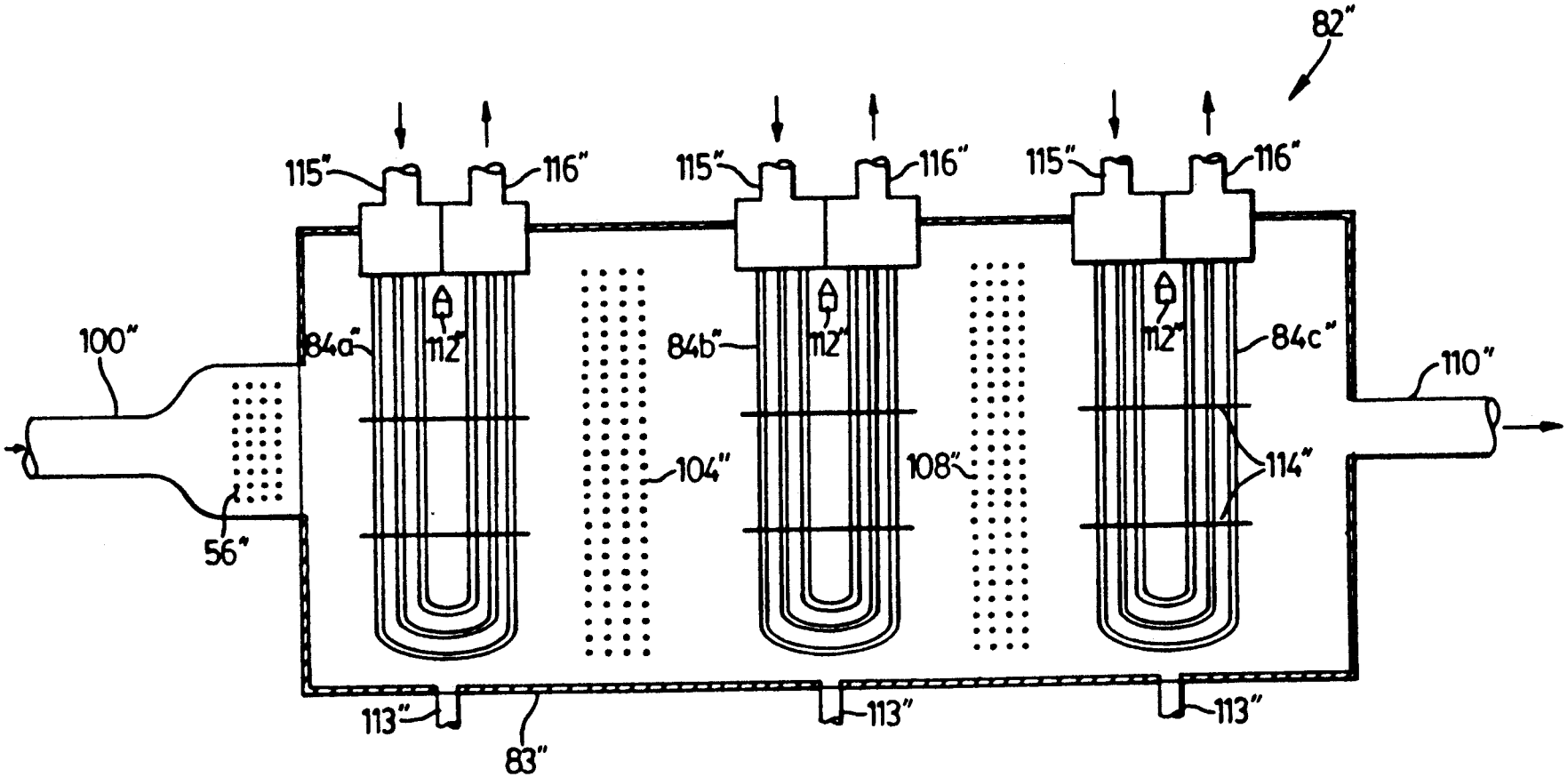
FIG. 5 is a schematic representation of a further heat exchanger which integrates multiple charging and condensing zones within one unit.

Another heat exchanger structure which can be used is diagrammatically shown in FIG. 5, where double primed reference numerals indicate parts corresponding to those of the preceding figures. In FIG. 5, the heat exchanger 82'', instead of having a vertically oriented cylindrical shell 83 as shown in FIGS. 3 and 4, has a horizontally extending housing 83'' which will typically be square or rectangular in cross-section. Bundles of U-shaped tubes **84*a*'', 84*b*'', 84*c*'' are located in housing 83'' and are horizontally spaced apart from each other. Baffles 114'' help support the tubes. The tubes of each bundle 84*a*'', 84*b*'', 84*c*'' have vertically extending legs joined at a lower bight, and each bundle has an entrance and exit 115'', 116''** respectively for cooling water.

Saturated gas enters the housing 83'' at inlet 100'' and is there charged by charging electrodes 56''. The gas then travels horizontally through tube bundle **84*a*'' where condensation and particle removal occur; then through further charging electrodes 104'' for re-charging, and then after passing through tube bundle 84*b*'', passes through further charging electrodes 108''. The gas then passes through tube bundle 84*c*'' for final condensation and particle removal, and then leaves through exit 110''. Spray nozzles 112'' may be provided as before, to assist in the condensation and particle collection. Drainage outlets 113'' drain collected liquids and solids. It will be appreciated that the FIG. 5** condenser or heat exchanger can be scaled up to virtually any size, thus providing a single gas cleaning unit for almost any plant.

Depending on the number of particles in the gas, gas residence times in the charging zones may be varied to obtain optimal charging. For particle numbers in the order of $10^{13}$ or higher per cubic meter, a preferred residence time within the charger will be in the order of one second, whereas 0.1–0.2 seconds will suffice when the number of particles is in the order of $10^{11}$ or less. A residence time of 0.5 seconds is preferably employed for intermediate particle numbers in the order of $10^{11}$ to 10—particles. For large particle loads pulse charging is the preferred method of charging in the first charging zone. Electric bombardment is suitable for subsequent charging stages when the particle number has been reduced.

As discussed above, gas leaving the last condenser stage contains residual water and sulfuric acid vapours which may be removed by charging the liquid particles in the gas and processing the charged gas in a conventional drying tower 72.

Figure 6:
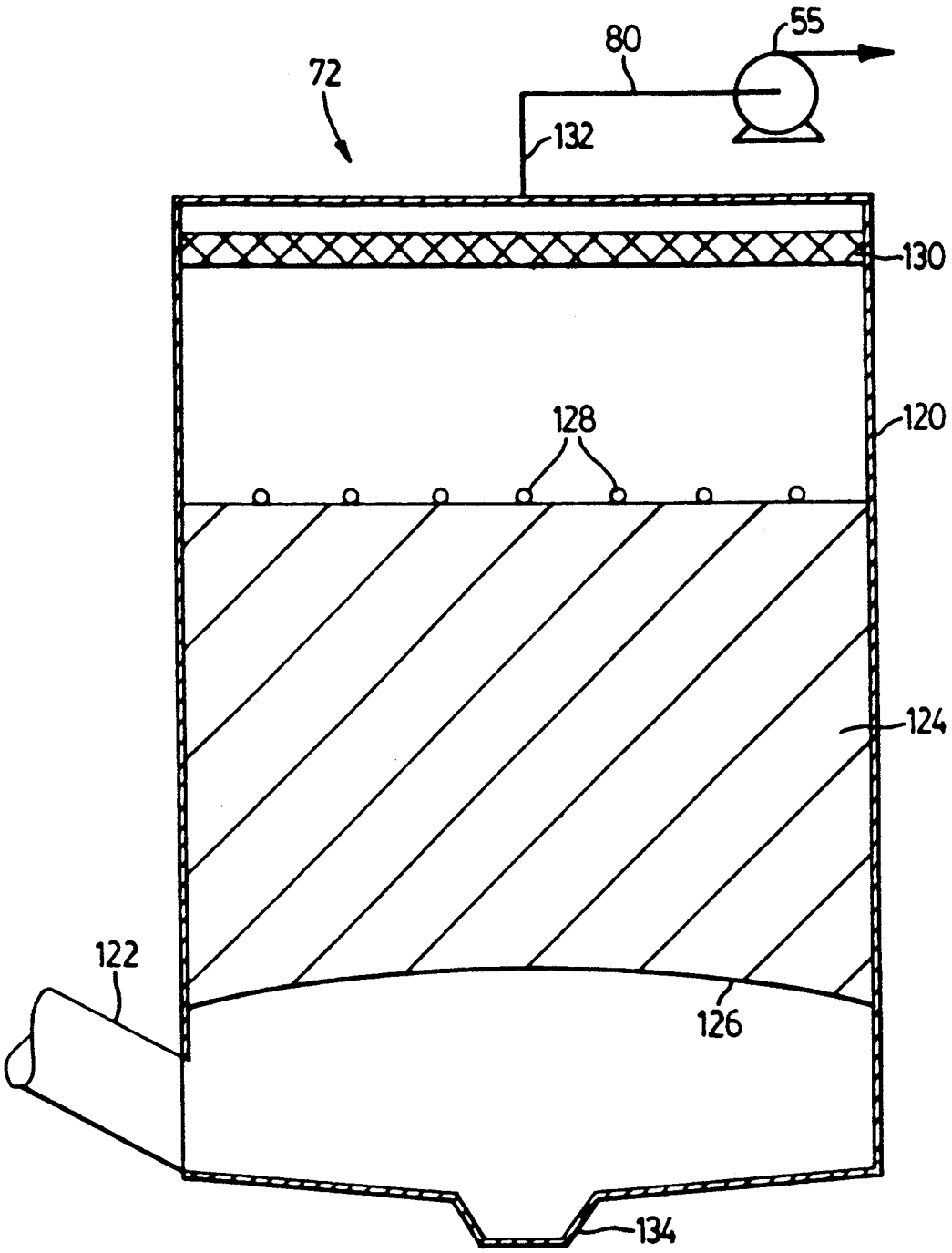
FIG. 6 is a schematic representation of a section of a typical drying tower which may be used in the process of the present invention.

As shown in FIG. 6, the conventional drying tower 72 comprises a vertical cylindrical vessel 120, a gas inlet 122, a section of packing 124 which is typically 4 meters deep, a support plate 126 for said packing, a number of sulfuric acid inlets 128 (to distribute acid over the packing), a mist eliminator 130, an upper gas outlet 132, and a bottom sulfuric acid outlet 134. The vessel is typically brick lined and made of carbon steel. Conventional ceramic packing material of a variety of shapes may be employed. Typical sulfuric acid concentrations employed to scrub the gas are about 93% or stronger. A suitable temperature range for the scrubbing acid is between 40 and 70 degrees centigrade. This acid is typically 2 degrees centigrade hotter and ½% more dilute after the gas has been scrubbed. Inlet gas flows upward through the tower against the countercurrent flow of acid and leaves the top of the tower as stream 80 after passing through the mist eliminator. The cleaned gas stream 80 then passes to the blower 55 and then to the contact section of the plant.

It will be appreciated that in this description, and in the appended claims, "particle" means both solid and liquid particles, including in particular the fine liquid droplets commonly found in a chemical fume.

I claim:

1. A process for cleaning smelter and other furnace gases containing sulfur oxides, comprising the steps of:

(a) cooling and saturating the gas by contact with a stream containing water, (b) electrostatically charging particles in the saturated gas thereby producing charged particles in said gas, (c) substantially immediately after charging said particles, and without an intermediate precipitation step, passing said gas containing said charged particles through a condenser, thereby directing into said condenser at least most of said charged particles produced during said electrostatic charging step, (d) removing water from said gas in said condenser, (e) the passage of said gas containing said charged particles through said condenser also at the same time removing from said gas most of said charged particles produced in said electrostatic charging step, (f) removing from said condenser a liquid stream comprising water condensed from said gas, and with said stream, also substantially removing the particles removed from said gas, so that said condenser performs the dual function of removing water from said gas and at the same time removing from said gas most of said charged particles produced in said electrostatic charging step.

2. A process according to claim 1 and including the step of spraying additional liquid comprising water into said gas in said condenser to help remove said charged particles from said gas and to help remove said removed particles from said condenser.

3. A process according to claim 1 wherein the saturated gas is passed through at least two cycles each comprising electrostatic charging followed substantially immediately by condensation.

4. A process according to claim 3, in which the gas leaving the last cycle of condensation is again electrostatically charged and is then passed through a sulfuric acid drying tower.

5. A process according to claim 1 wherein said condenser comprises tubes within a housing and the gas being cleaned flows through said tubes of said condenser.

6. A process according to claim 1 wherein said condenser comprises tubes within a housing, and the gas being cleaned flows within said housing external to said tubes.

7. A process according to claim 1 wherein said gas containing said charged particles is passed through some of the tubes of a heat exchanger having heat exchange tubes, and is then recharged and passed through further tubes of the same heat exchanger.

8. A process according to claim 1 wherein said gas containing said charged particles is passed through a first condensation zone within a housing and external to the tubes of a heat exchanger, and is then recharged and passed through a second condensation zone within the housing and external to further tubes of the same heat exchanger.

9. Apparatus for cleaning smelter and other furnace gases containing sulfur oxides, comprising:

(a) means for cooling and saturating the gas by contact with a stream containing water, the cooled and saturated gas containing particles, (b) charging means connected to said cooling and saturating means for electrostatically charging said particles in the gas therefrom to produce a stream of saturated gas containing charged particles, (c) at least one condenser connected substantially immediately downstream of said electrostatic charging means, and without a precipitator collecting surface between said electrostatic charging means and said condenser, for said condenser to receive said stream of saturated gas with such stream containing substantially all of the charged particles produced by said charging means, for said condenser to condense water vapour from said saturated gas and at the same time to remove therefrom most of said charged particles produced by said charging means, (d) said condenser including means for draining condensed water and collected particles therefrom, so that said condenser performs the dual function of removing water from said gas and at the same time removing from said gas most of said charged particles produced by said electrostatic charging means.

10. Apparatus according to claim 9 wherein said condenser includes means for spraying liquid comprising water into said saturated gas containing said charged to help remove particles charged particles from said gas and to help remove said removed particles from said condenser.

11. Apparatus according to claim 9 including a plurality of said condensers, and means substantially immediately upstream of each condenser for electrostatically charging the gas entering each condenser.

12. Apparatus according to claim 9 including a sulfuric acid drying tower connected to receive gas from the last condenser, and charging means between said last condenser and said drying tower for electrostatically charging the gas entering said drying tower.

13. Apparatus according to claim 9 wherein said condenser comprises a heat exchanger having a housing, a plurality of tubes extending through said housing, a plurality of sheets dividing the interior of said housing into at least two condensing zones, each transversed by said tubes, gas conduit means connecting said condensing zones, said conduit means including electrostatic charging means therein, one of said zones having an inlet for said saturated gas containing said particles, another of said zones having an outlet for cooled cleaned gas.

14. Apparatus according to claim 9 wherein said condenser comprises a heat exchanger having a housing and a plurality of tubes extending through said housing, said tubes being divided into at least first and second sets, gas connection means connecting said tube sets, said connection means including electrostatic charging means therein, one of said sets having an inlet for said saturated gas containing said particles, the other set having an outlet for cooled cleaned gas.

* * * * *